US005155411A

United States Patent [19]

Swank et al.

[11] Patent Number: 5,155,411

[45] Date of Patent: Oct. 13, 1992

[54] COLOR CRT ASSEMBLY HAVING AN IMPROVED ENVELOPE

[75] Inventors: Harry R. Swank, Lancaster; Anthony S. Poulos, Leola, both of Pa.

[73] Assignee: Thomson Consumer Electronics, Inc., Indianapolis, Ind.

[21] Appl. No.: 655,481

[22] Filed: Feb. 14, 1991

[51] Int. Cl.[5] ..... H01J 29/52

[52] U.S. Cl. ..... 313/477 R; 313/106

[58] Field of Search ..... 313/477 R, 106; 358/245, 246; 220/2.1 A

[56] References Cited

U.S. PATENT DOCUMENTS

| | | | |
|---|---|---|---|
| 2,969,162 | 1/1961 | Stutske | 220/2.1 |
| 3,005,122 | 10/1961 | Coleman et al. | 313/64 |
| 3,161,314 | 12/1964 | Pfleeger et al. | 220/2.1 |
| 3,591,035 | 7/1971 | Gossie et al. | 220/2.1 |
| 3,720,345 | 3/1973 | Logue | 220/2.1 |
| 3,806,750 | 4/1974 | Tsuneta et al. | 313/64 |
| 3,934,169 | 1/1979 | Groothoff et al. | 313/477 R |
| 4,264,931 | 4/1981 | Gehl et al. | 358/245 |
| 4,949,010 | 8/1990 | Petersen et al. | 313/477 R |

OTHER PUBLICATIONS

EIA Standard, EIA-501-AS, May 1990, pp. 1-9; A-1.

*Primary Examiner*—Donald J. Yusko
*Assistant Examiner*—N. Patel
*Attorney, Agent, or Firm*—Joseph S. Tripoli; Dennis H. Irlbeck; Vincent J. Coughlin, Jr.

[57] ABSTRACT

A color CRT assembly comprises a tube having an external magnetic deflection yoke thereon. The tube includes an evacuated envelope with a substantially rectangular faceplate panel and a tubular neck connected by a funnel having a rectangular open end sealed to the faceplate panel. A three color phosphor screen is carried on an inner surface of the faceplate panel and a color selection electrode is mounted in spaced relation therefrom. An electronic gun is disposed within the neck of the tube for generating and directing at least one electron beam to the screen. The magnetic deflection yoke is located on the tube, in the region of the funnel-to-neck junction of the envelope, for subjecting the beam to magnetic fields which cause the beam to scan a rectangular raster over the screen. The assembly is improved by the inclusion, in the funnel, of a quantity of glass which attenuates x-radiation from the tube. The quantity of glass is disposed adjacent to the yoke, on the faceplate side thereof. The quantity of glass may take the form either of an annular ring or a ring interrupted by gaps formed along the major and minor axes of the tube.

9 Claims, 5 Drawing Sheets

COLOR CRT ASSEMBLY HAVING AN IMPROVED ENVELOPE

This invention relates to a color cathode-ray tube (CRT) assembly comprising a color CRT and an external magnetic deflection yoke and, more particularly, to a color CRT assembly having an improved tube envelope, with x-radiation attenuation means.

BACKGROUND OF THE INVENTION

Very large screen (VLS), direct-view, television receivers presently are being introduced into the home entertainment markets, both in the United States and abroad. Current domestic screen sizes include 79 cm (31V) and 89 cm (35V), 110° deflection tubes, in a conventional 4×3 aspect ratio (width-to-height). An 86 cm (34V) 106° deflection tube, in a 16×9 aspect ratio, is about to be introduced abroad. A common yoke has been designed which can be used on all of these tube types; however, the yoke differs from prior yokes, in that it is shorter and overlies less of the tube envelope funnel.

During the operation of a television receiver, the electron beams of the tube are accelerated by high voltages applied to elements within the tube. Portions of each of the beams, which do not strike color-emissive phosphor elements on a screen, are intercepted by a shadow mask or impinge on other internal tube components, and x-rays are emitted. The tube is fabricated of x-ray absorptive glass and other shielding is utilized, to keep the level of x-ray emission below a limit of 0.5 millirem per hour (mR/h), at an anode current of 300 μA, during normal operation. However, in a failure mode, in which the anode voltage exceeds design limits, x-rays can be emitted from the rear of the tube, adjacent to the yoke. With prior yokes, which extend further along the funnel, this x-radiation is partially absorbed by the yoke materials; however, the present, shorter, yokes do not extend over that portion of the funnel from which x-rays are emitted. A need thus exists for a means for attenuating the x-radiation that otherwise would be emitted from a tube, during some types of receiver failure.

SUMMARY OF THE INVENTION

A color CRT assembly comprises a tube, including an evacuated envelope, with a substantially rectangular faceplate panel and a tubular neck connected by a funnel having a rectangular open end sealed to the faceplate panel. A three color phosphor screen is carried on an inner surface of the faceplate panel. A color selection electrode is mounted in spaced relation to the screen. An electron gun is disposed within the neck, for generating and directing at least one electron beam to the screen. An external magnetic deflection yoke is located on the tube, in the region of the funnel-to-neck junction of the envelope, for subjecting the beam to magnetic fields which cause the beam to scan a rectangular raster over the screen. The assembly is improved by providing the funnel with x-radiation attenuating means. The x-radiation attenuation means is adjacent to the yoke, on the faceplate panel side thereof.

DETAILED DESCRIPTION OF THE PREFERRED EMBODIMENTS

Figure 1:
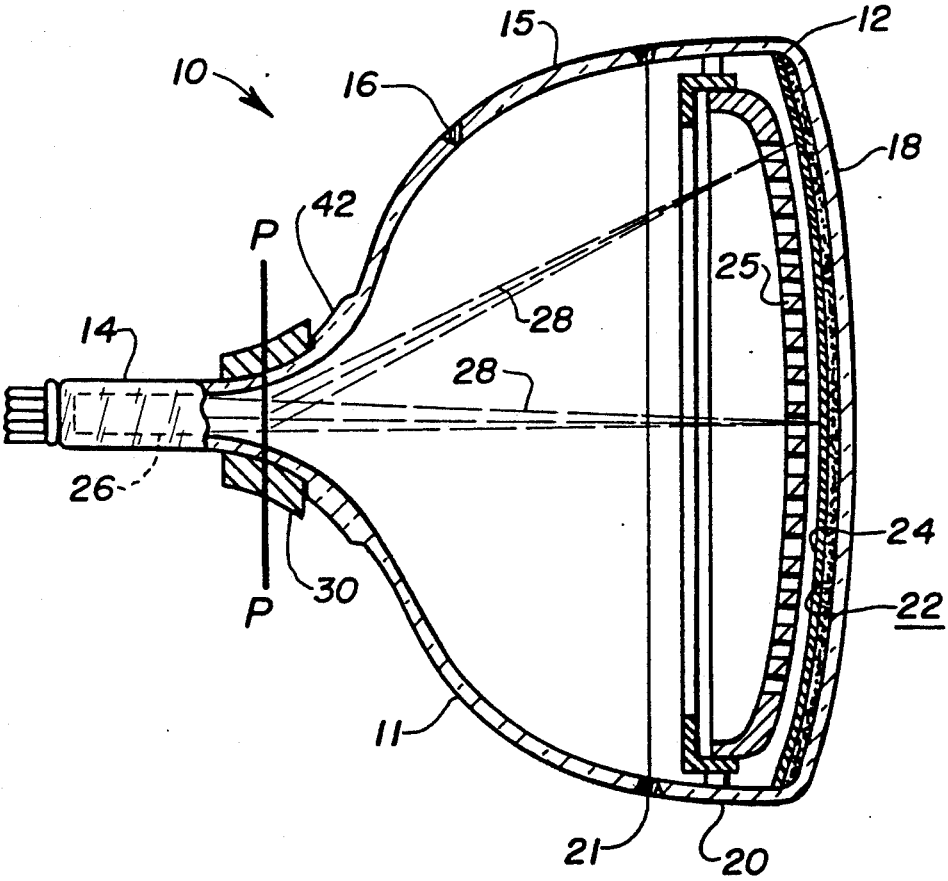
FIG. 1 is a plan view, partially in axial section, of a color cathode-ray tube (CRT) assembly embodying the present invention.

FIG. 1 shows a color CRT assembly 10, having a glass envelope 11, comprising a rectangular faceplate panel 12 and a tubular neck 14, connected by a funnel 15 having a rectangular open end. The funnel 15 has an internal conductive coating (not shown) that contacts an anode button 16 and extends into the neck 14. The panel 12 comprises a viewing faceplate, or substrate, 18 and a peripheral flange, or sidewall, 20, which is sealed to the rectangular open end of the funnel 15, by a glass frit 21. A three color phosphor screen 22 is carried on the inner surface of the faceplate 18. Preferably, the screen 22 is a line screen, which includes a multiplicity of screen elements comprised of red-emitting, green-emitting and blue-emitting phosphor stripes R, G and B, respectively, arranged in color groups, or picture elements, of three stripes, or triads, in a cyclic order. The stripes extend in a direction which is generally normal to the plane in which the electron beams are generated. In the normal viewing position of the embodiment, the phosphor stripes extend in the vertical direction. Preferably, at least a portion of the phosphor stripes overlap a relatively thin, light-absorptive matrix, as is known in the art. Alternatively, the screen can be a dot screen. A thin conductive layer 24, preferably of aluminum, overlies the screen 22 and provides a means for applying a uniform potential to the screen, as well as for reflecting light, emitted from the phosphor elements, through the faceplate 18.

Figure 4:
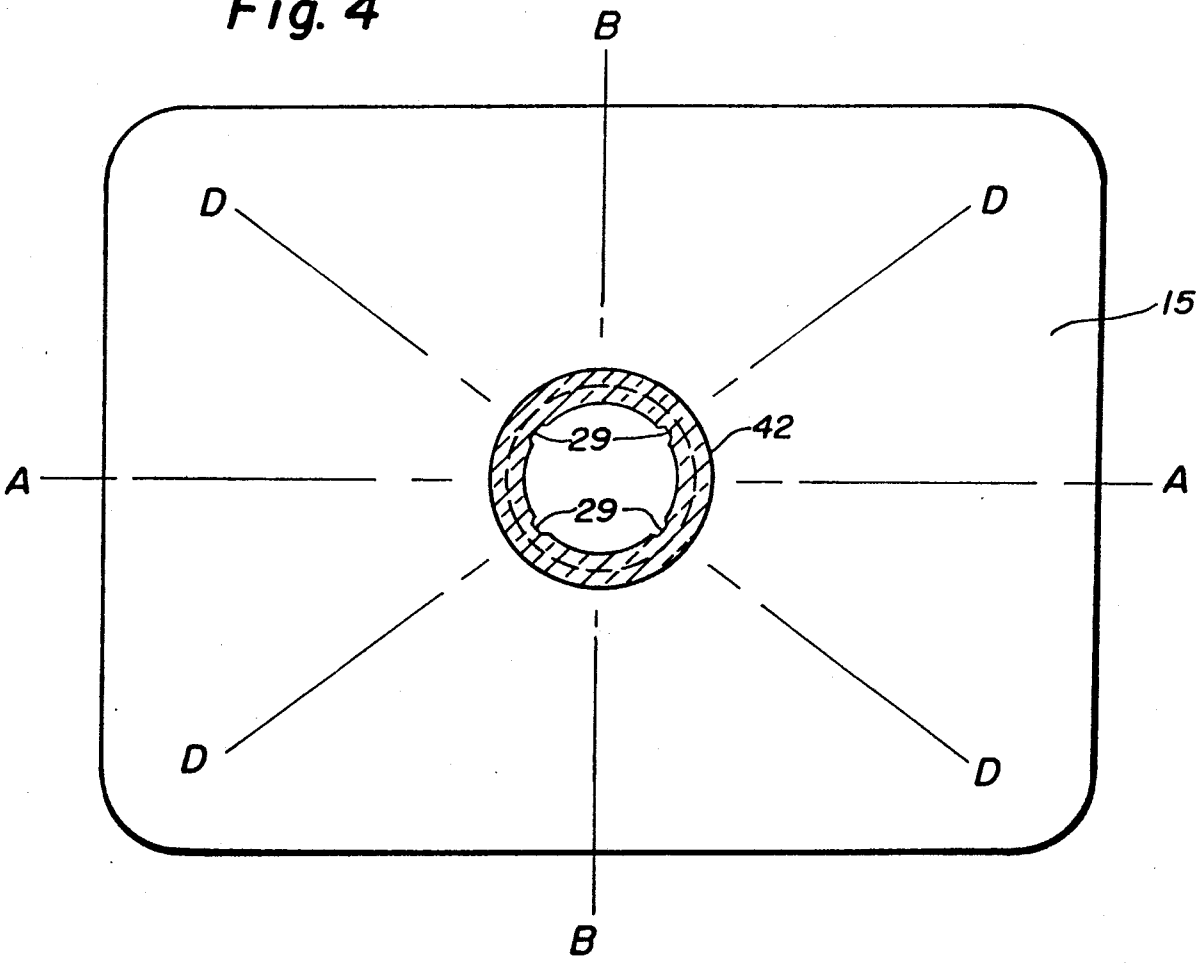
FIG. 4 is a cross sectional view taken along line 4—4 of FIG. 2, showing one embodiment of the present invention.
Figure 5:
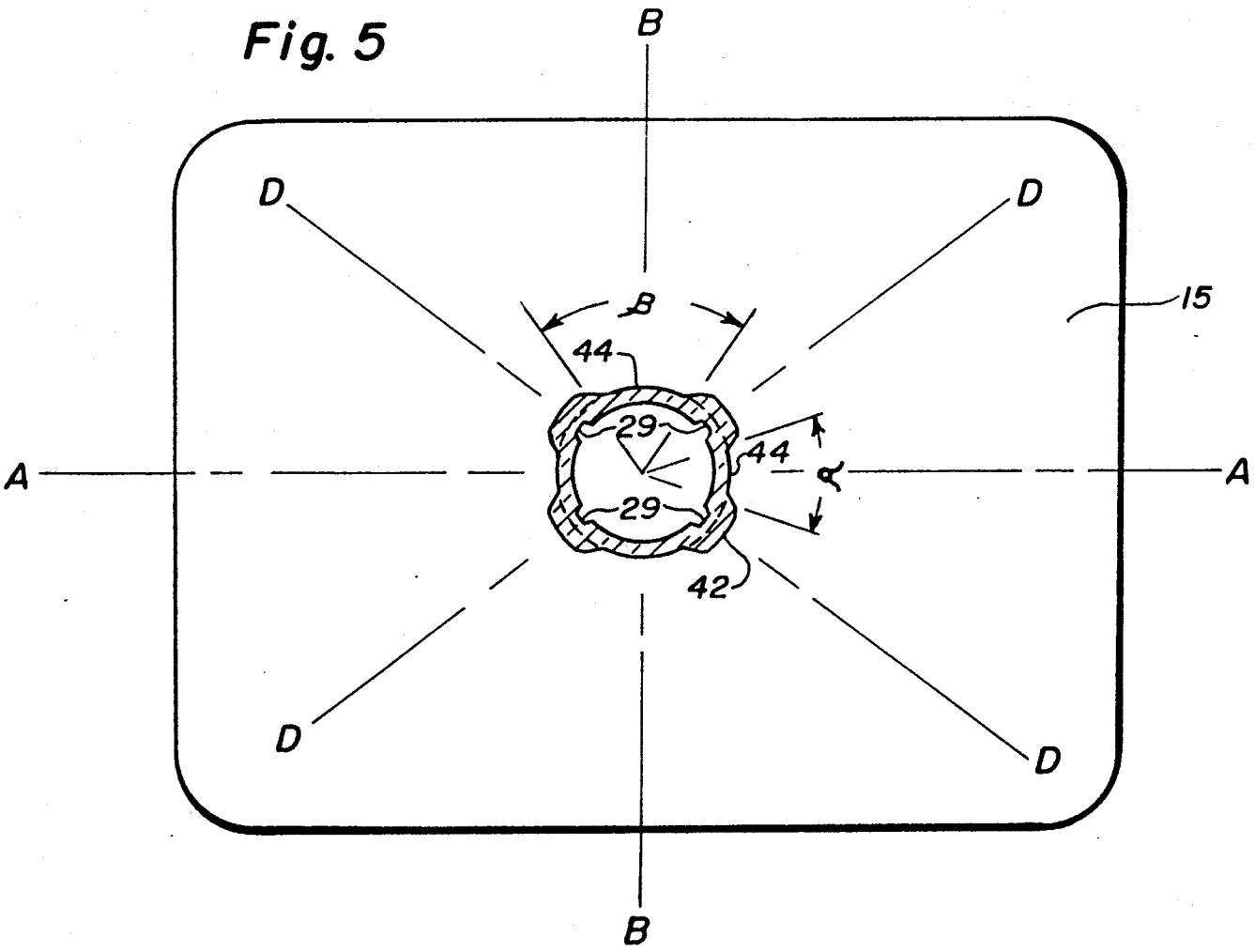
FIG. 5 is a cross sectional view showing a second embodiment of the invention.

A multi-apertured color selection electrode, or shadow mask, 25 is removably mounted, by conventional means, in predetermined spaced relation to the screen 22. An electron gun 26, shown schematically by the dashed lines in FIG. 1, is centrally mounted within the neck 14, to generate and direct three electron beams 28 along convergent paths, through the apertures in the mask 25, to the screen 22. A plurality of radial grooves 29, shown in FIGS. 4 and 5, are provided in a rectangular pattern in the interior surface of the funnel 15. The grooves 29 are formed in the same orientation as the diagonals D—D of the large open end of the funnel, to permit the electron beams 28 to be deflected to the corners of the screen 22. The grooves 29 typically have a depth of about 1.5 to 5 mm, although 3 to 4 mm is preferred. Some funnels do not utilize grooves; nevertheless, the present invention is applicable to such structures.

Figure 2:
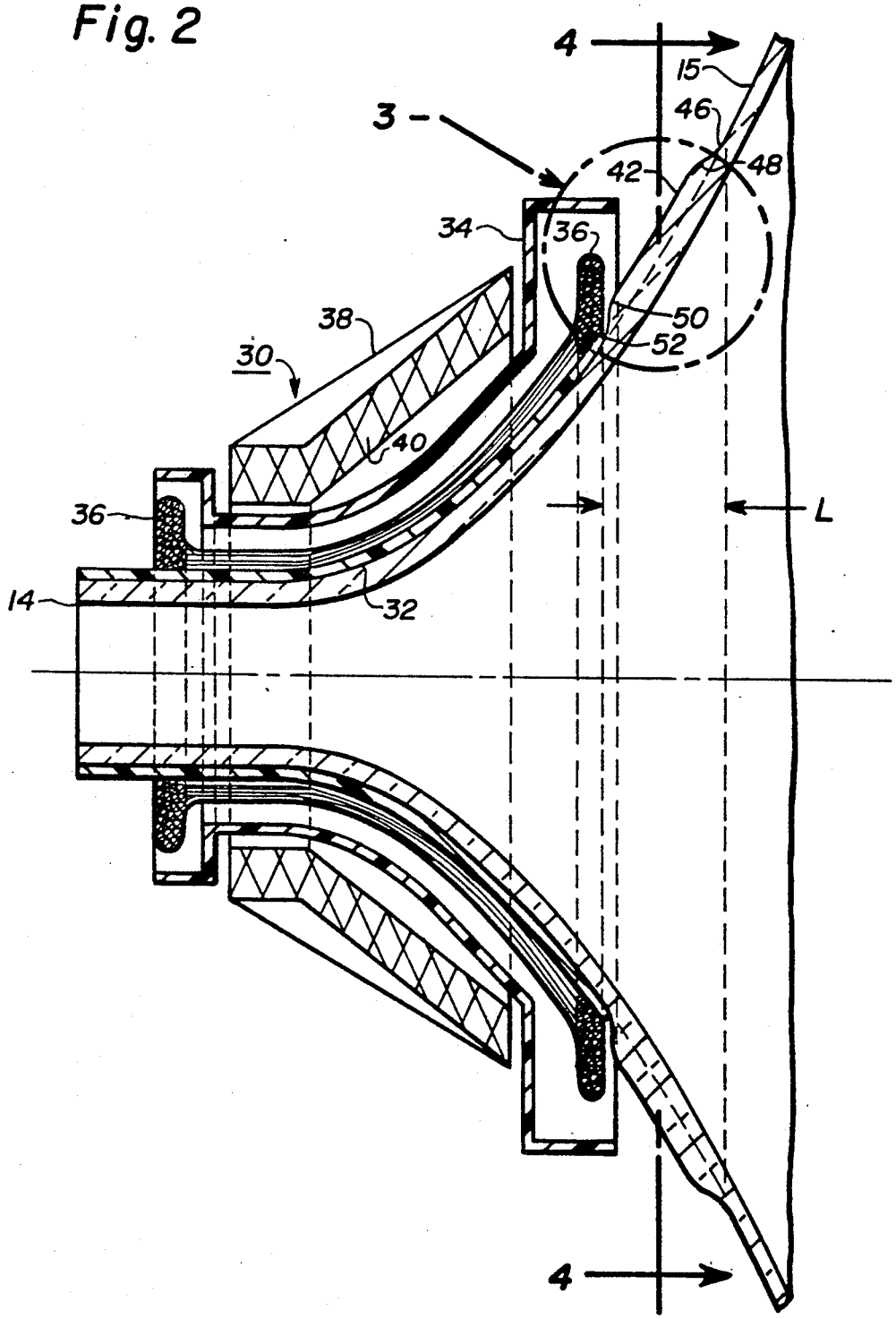
FIG. 2 is a cross sectional view of a portion of the color CRT assembly shown in FIG. 1.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown. With reference to FIG. 2, the deflection yoke 30 overlies a flexible electrically nonconductive plastic sleeve 32, and is attached thereto by a quantity of adhesive, not shown. The deflection yoke 30 illustratively comprises an electrically nonconductive plastic liner 34, saddle-wound horizontal deflection coils 36, and vertical deflection coils 38, toroidally wound on a magnetically permeable core 40.

Figure 3:
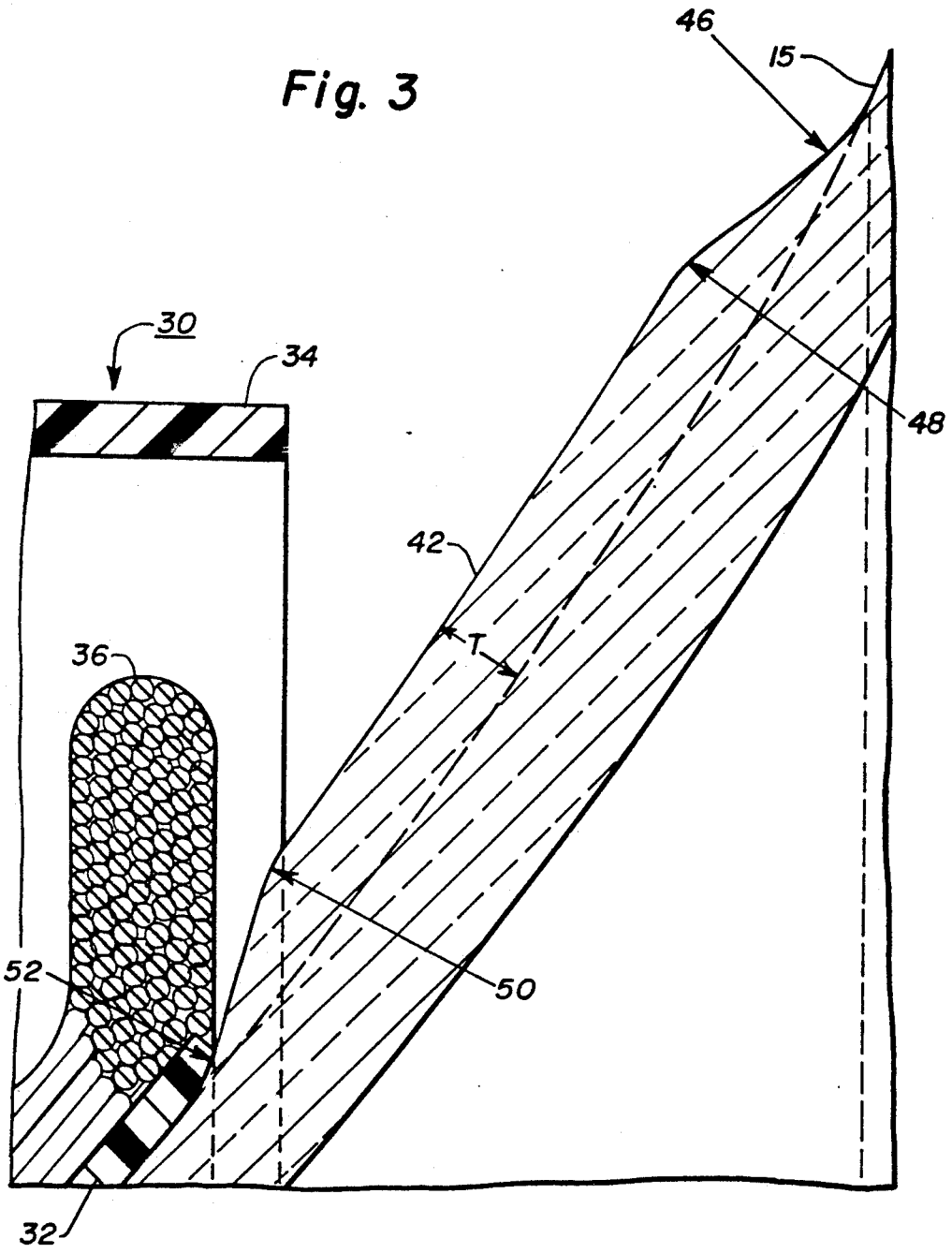
FIG. 3 is an enlargement of the portion shown within the circle 3, in FIG. 2.

The present CRT assembly differs from prior CRT assemblies in that a quantity of glass 42 is positioned adjacent to, and immediately forward of, the location of the yoke 30, on the faceplate panel side of the funnel 15. Preferably, the glass 42 is formed as an annular ring, as shown in FIG. 4, or, alternatively, the annular ring may have a plurality of gaps 44 formed therein, as shown in FIG. 5. Again with reference to FIGS. 2 and 3, the ring of glass 42 has a leading edge 46 and a first knee 48, each of which has a radius of about 10 mm. The body of the ring 42 has a substantially constant thickness, T, of about 3 mm, is formed integral with the sidewall of the funnel 15 and has the same glass composition as the funnel. The ring 42 also has a second knee 50, with a radius of about 7 mm, and a trailing edge 52, that has a radius of about 8 mm. Typically, the longitudinal projection, L, of the ring 42 is about 18 mm. These values are meant to be illustrative, rather than limiting, for a 79 cm (31V) tube, and variations of these dimensions are within the scope of this invention.

The ring 42 provides additional attenuation of x-rays generated by the electron beams impinging on internal tube components such as the shadow mask 25, and various shields (not shown). Most of the x-rays are reflected toward the rear of the tube 10 and impinge on the funnel 15, in the vicinity of the yoke 30 and the novel ring 42. Under test conditions, with an anode voltage of 43 kV applied to the tube and an anode current of about 300 $\mu$A, the x-radiation detected is within the range of 0.13 to 0.14 mR/h, compared to about 0.19 mR/h without the ring 42.

FIG. 5 shows a second embodiment of the present invention. The ring 42 is interrupted by the gaps 44 which lie along the major and minor axes, A—A and B—B, respectively, of the tube 10. The major axis gap subtends an angle $\alpha$, while the minor axis gap subtends an angle $\beta$. Each of the angles $\alpha$ and $\beta$ ranges between 20 and 60 degrees. The ring 42, in the second embodiment, overlies the grooves 29 formed in the funnel 15, and provides sufficient external glass to attenuate the x-radiation, to a safe level, below the industry limit.

What is claimed is:

1. In a color cathode-ray tube assembly comprising a tube, having an evacuated envelope with a substantially rectangular faceplate panel and a tubular neck connected by a funnel with a rectangular open end sealed to said faceplate panel, a three color phosphor screen carried on an inner surface of said faceplate panel, a color selection electrode assembly in spaced relation to said screen, an electron gun disposed within said neck, for generating and directing at least one electron beam to said screen, and an external magnetic deflection yoke located on the tube, in the region of the funnel-to-neck junction of said envelope, for subjecting said beam to magnetic fields, which cause said beam to scan a rectangular raster over said screen, the improvement wherein said funnel includes means, disposed adjacent to and immediately forward of said yoke, on said faceplate panel side thereof, for attenuating x-radiation from said tube.

2. The tube assembly as described in claim 1, wherein said means for attenuating x-radiation includes a quantity of glass for selectively increasing the thickness of said funnel.

3. The tube assembly as described in claim 2, wherein said quantity of glass comprises an annular ring integral with said funnel.

4. In a color television picture tube assembly comprising a picture tube, having an evacuated glass envelope with a substantially rectangular faceplate panel and a tubular neck connected by a funnel with a rectangular open end sealed to said faceplate panel, said funnel including a pattern of radial grooves formed in the same orientation as the diagonals of said rectangular open end, a three color phosphor screen carried on an inner surface of said faceplate panel, a shadow mask assembly in spaced relation to said screen, an electron gun disposed within said neck for generating and directing three electron beams to said screen, and an external magnetic deflection yoke located on said picture tube, in the region of the funnel-to-neck junction of said envelope, for subjecting said beams to magnetic fields which cause said beams to scan a rectangular raster over said screen, the improvement wherein said funnel includes a quantity of glass disposed adjacent to and immediately forward of said yoke, on the faceplate panel side thereof, said glass selectively increasing the thickness of the funnel to attenuate x-radiation from said tube.

5. The tube assembly as described in claim 4, wherein said quantity of glass comprises an annular ring integral with said funnel.

6. The tube assembly as described in claim 4, wherein said quantity of glass overlies said radial grooves.

7. In a color cathode-ray tube comprising an evacuated envelope with a substantially rectangular faceplate panel and a tubular neck connected by a funnel having a rectangular open end sealed to said faceplate panel, said envelope having a deflection yoke location in the region of the funnel-to-neck junction, a three color phosphor screen carried on an inner surface of said faceplate panel, a color selection electrode assembly in spaced relation to said screen, and an electron gun disposed within said neck for generating and directing at least one electron beam to said screen, the improvement wherein said funnel includes means, disposed adjacent to and immediately forward of said deflection yoke location, on said faceplate panel side thereof, for attenuating x-radiation from said tube.

8. The tube as described in claim 7, wherein said means for attenuating x-radiation includes a quantity of glass for selectively increasing the thickness of said funnel.

9. The tube as described in claim 7, wherein said quantity of glass comprises an annular ring integral with said funnel.

* * * * *